US006967638B2

(12) United States Patent
Janssen et al.

(10) Patent No.: US 6,967,638 B2
(45) **Date of Patent: *Nov. 22, 2005**

(54) CIRCUIT AND METHOD FOR ADDRESSING MULTIPLE ROWS OF A DISPLAY IN A SINGLE CYCLE

(75) Inventors: Peter J. Janssen, Scarborough, NY (US); Lucian Remus Albu, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 591 days.

This patent is subject to a terminal disclaimer.

(21) Appl. No.: 10/165,905

(22) Filed: Jun. 10, 2002

(65) Prior Publication Data

US 2003/0227432 A1 Dec. 11, 2003

(51) Int. Cl.[7] ..... G09G 3/36
(52) U.S. Cl. ..... 345/98; 345/100

(58) Field of Search ..... 345/87, 94, 92, 345/99, 100, 97, 98

(56) References Cited

U.S. PATENT DOCUMENTS 6,034,921 A * 3/2000 Viot et al. ..... 365/239
6,738,036 B2 * 5/2004 Janssen et al. ..... 345/87

* cited by examiner

*Primary Examiner*—Kent Chang

(57) ABSTRACT

A row addressing circuit and method for addressing multiple rows of a visual display in a single cycle. The circuit comprises: a decoder coupled to a plurality of signal lines, wherein the decoder includes a system for decoding a row select address, a first pre-write address and a second pre-write address and selecting three corresponding signals lines during the single cycle; and wherein each of the plurality of signal lines is further coupled to a dedicated set of latches, wherein each set of latches includes a row select latch, a first pre-write latch, and a second pre-write latch.

16 Claims, 2 Drawing Sheets

CIRCUIT AND METHOD FOR ADDRESSING MULTIPLE ROWS OF A DISPLAY IN A SINGLE CYCLE

BACKGROUND OF THE INVENTION

1. Technical Field

The present invention relates generally to row addressing circuits for video displays, and more particularly relates to a single decoder based row addressing circuit that utilizes dedicated latches to enable multiple pre-writes.

2. Related Art

Video display systems have become commonplace in today's electronics marketplace. Laptops, flat screen monitors, televisions, video cameras, digital cameras, personal digital assistants, cell phones, etc., all typically utilize some form of a video display. As the demand for more and more advanced electronic systems continues to grow, the need to provide improved performance for visual displays remains an ongoing challenge.

A typical visual display, such as a liquid crystal display (LCD), is typically configured as an active matrix of pixels that are loaded with pixel data on a row-by-row basis. Each row is selected with a unique address, thereby allowing data to be addressed to individual rows within the display. In advanced display systems, it is advantageous to be able to simultaneously address rows other than the one being written to with picture information. Moreover, in applications such as a single panel, scrolling color application, the ability to address non-contiguous rows is required.

Simultaneous row addressing (i.e., the ability to address multiple rows during a single cycle) is required, for instance, in applications where the process of erasing a previous pixel state needs to be implemented. For example, in high-speed LCD systems, it is necessary to pre-write some blank information to the row of pixels before writing the actual picture because LCD's generally have a relatively long memory period. Often, multiple pre-writes (e.g., two or more) are preferable. Accordingly, systems are required that can address some rows with pre-write data during the same cycle when a row is addressed with picture data.

Prior art systems that provide this functionality typically utilize hardwired logic that allows a row (e.g., row n) and one or more offset rows (e.g., row n-100) to be selected simultaneously. Unfortunately, this requires a very high number of circuits and limits flexibility. Thus, advanced features, such as bi-directional scanning cannot readily be implemented.

SUMMARY OF THE INVENTION

The present addresses the above-mentioned problems, as well as others, by providing an addressing scheme that utilizes a single decoder and a set of dedicated latches for each row. In a first aspect, the invention provides a row addressing circuit for addressing multiple rows of a visual display in a single cycle, comprising: a decoder coupled to N row select lines, wherein a subset M of the N row select lines are selectable by the decoder in response to M inputted row addresses; and a set of M latches coupled to each of the N row select lines, wherein each set of latches comprises a row select latch and a first pre-write latch.

In a second aspect, the invention provides a method of addressing multiple rows of a visual display in a single cycle, comprising: providing a decoder coupled to a plurality of signal lines, wherein each signal line is further coupled to a dedicated latch including a row select latch, a first pre-write latch, and a second pre-write latch; providing a first enable signal line that is shared by each of the row select latches, a second enable signal line that is shared by each of the first pre-write latches, and a third enable signal line that is shared by each of the second pre-write latches; beginning a row cycle; inputting and decoding a row select address and selecting a first signal line; enabling the row select latch via the first enable signal line; inputting and decoding a first pre-write address and selecting a second signal line; enabling the first pre-write latch via the second enable signal line; inputting and decoding a second pre-write address and selecting a third signal line; enabling the second pre-write latch via the third enable signal line; and ending the row cycle.

In a third aspect, the invention provides a row addressing circuit for addressing multiple rows of a visual display in a single cycle, comprising: a decoder coupled to a plurality of signal lines, wherein the decoder includes a system for decoding a row select address, a first pre-write address, and a second pre-write address and selecting three corresponding signals lines during the single cycle; and wherein each of the plurality of signal lines is further coupled to a dedicated latch set, wherein each latch set includes a row select latch, a first pre-write latch, and a second pre-write latch.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE INVENTION

Figure 1:
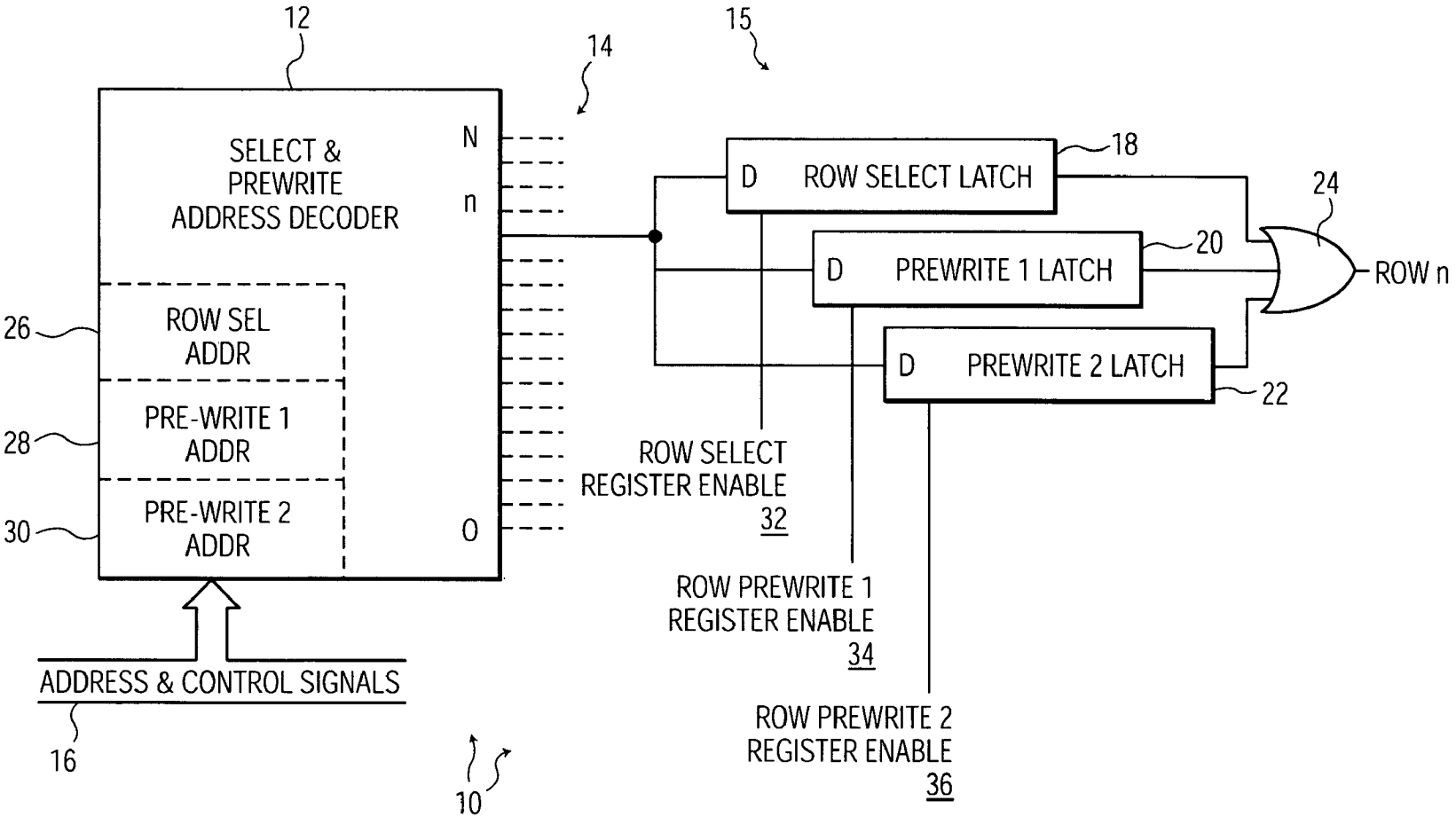
FIG. 1 depicts a decoder based row select circuit with pre-write in accordance with the present invention.

Referring now to the drawings, FIG. 1 depicts a row addressing circuit 10 that allows multiple rows of a display to be addressed during a single cycle. A cycle is generally defined a period of time during which a row within the display is made active to display data. In one exemplary embodiment, the display may comprise an active matrix display utilizing a liquid crystal display (LCD). However, it should be understood that the invention could be applied to any display application where multiple row addressing is required.

Row addressing circuit 10 includes a decoder 12 capable of, during a single cycle, sequentially decoding a plurality of M input addresses and activating M corresponding row select or signal lines 14. In an exemplary embodiment, the plurality of M addresses comprises a row select address 26, a first pre-write address 28, and a second pre-write address 30 (i.e., M=3). Row select address 26 identifies a row of the display that is to be made active for actual display data, i.e., data that be will be viewed. Pre-write address 28 identifies a second row that is to receive a first phase of pre-write data in order to clear the previous state of the second row. Pre-write address 30 identifies a third row that is to receive a second phase of pre-write data in order to further clear the previous state of the third row. The row select and pre-write operations are facilitated by a series of latches and control signals that are described in detail below. The addresses, as well as the control signals are communicated via a shared bus 16 and may be provided by any type of system, e.g., a processing unit. In this exemplary embodiment, the first and second pre-write operations are typically active for only a short portion of the row cycle, and are preferably written to a row for a predetermined period of time before the row is made active for actual display data (e.g., 100–200 microseconds, respectively). However, it should be understood that the number and specific functionality of the pre-write operations are not limited to the embodiments described herein, and variations (e.g., more than two pre-write operations) apparent to one skilled in the art fall within the scope of the present invention.

The decoder output is comprised of a plurality of N signal lines 14 that are individually selectable in response to an inputted address. Each of the plurality of N signal lines 14 is associated with a row of the display. Thus for example, if the display has 800 rows, the decoder will require 800 signal lines 14, i.e., N=800. As noted above, the present invention allows multiple rows (i.e., a set M of the N rows) to be activated during a single cycle. To accomplish this, each signal line 14 of circuit 10 is coupled to a dedicated set of M latches, i.e., a "latch set" 15, resulting in N×M total latches. In the exemplary embodiment depicted in FIG. 1, each latch set 15 includes a row select latch 18, a first pre-write latch 20, and a second pre-write latch 22. Note that for simplicity purposes, only one latch set 15 is shown, but the actual circuit 10 would include N latch sets.

In accordance with this exemplary embodiment, three of the N latch sets are selected during each cycle, as determined by the row select address 26, first pre-write address 28, and second pre-write address 30. A series of control signals provided over shared bus 16 enable one of the three latches in each selected latch set 15 during the cycle. Specifically, the control signals are comprised of a row select register enable signal 32; row prewrite 1 register enable signal 34; and row prewrite 2 register enable signal 36, which are shared among each latch set 15. Each latch in the latch set 15 includes an enable signal input for receiving the respective signal. In order to become active, a latch must be both selected by decoder 12 and enabled by the appropriate enable signal. Once active, the latch can hold and pass a high signal to the selected row of the display for a period of time determined by the enable signal.

Figure 2:
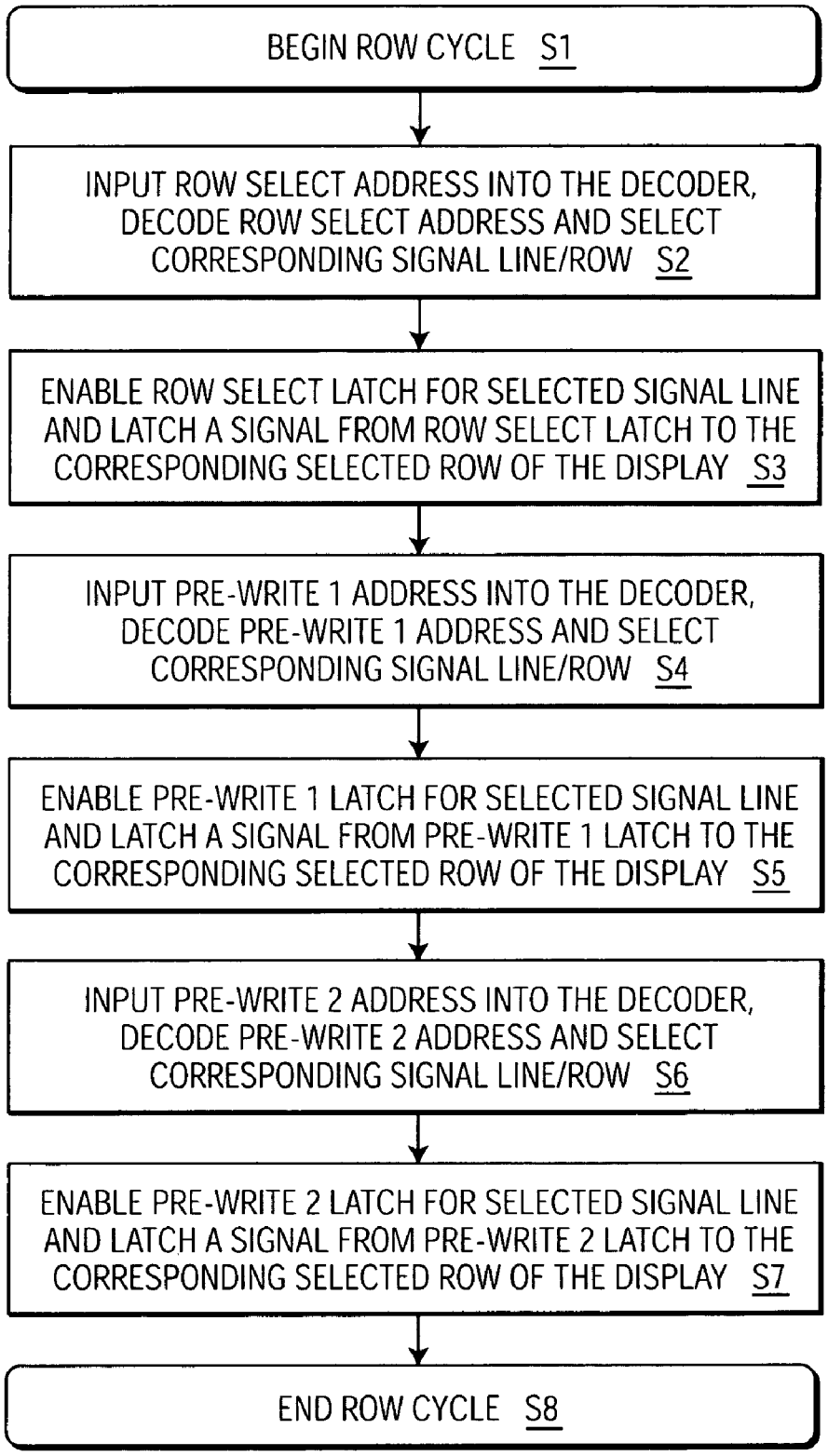
FIG. 2 depicts a flow diagram describing a method of the present invention.

Referring to FIG. 2, a more detailed operation of circuit 10 is provided. First, a row cycle begins at step S1. Next, a row select address 26 is written to decoder 12 from bus 16, which is decoded and causes a row n to be selected (step S2). At the same time, a row select register enable signal 32 is provided via bus 16 to each row select latch 18 (step S3). Because only one latch set (row n) is active, only the "row n" row select latch 18 is affected by the row select register enable signal 32. Thus, a high signal is saved in row select latch 15, which is transmitted through logical Or gate 24 to row n of the display.

Next, pre-write 1 address 28 is written to decoder 12 from bus 16. The pre-write 1 address 28 is decoded and causes a second signal line (e.g., n-100) to be selected (step S4). At the same time, a row prewrite 1 register enable signal 34 is provided via bus 16 to each prewrite 1 latch (step S5). Because only the second signal line (e.g., n-100) is active, the prewrite 1 latch of the selected latch set (e.g., n-100, not shown) latches the high signal to the selected row (e.g., n-100) for a first phase pre-write operation.

Next, pre-write 2 address 30 is written to decoder 12 from bus 16. The pre-write 2 address 30 is decoded and causes a third signal line (e.g., n-200) to be selected (step S6). At the same time, a row prewrite 2 register enable signal 34 is provided via bus 16 to each prewrite 2 latch (step S7). Because only the third signal line (e.g., n-200) is selected, the prewrite 2 latch of the selected latch set (e.g., n-200, not shown) latches the high signal to the selected row (e.g., n-200) for a second phase pre-write operation. Finally the row cycle ends (step S8).

As shown, the present invention allows three (or more) rows to be enabled independently during a single cycle allowing, among other things, independent row selection and independent control over the pre-write time. This invention therefore includes the option of extending, for example, the second pre-write to a full row time allowing picture information to be written into two rows during a single cycle (bi-row mode).

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

What is claimed is:

1. A row addressing circuit for addressing multiple rows of a visual display in a single cycle, comprising:

a decoder coupled to N row select lines, wherein a subset M of the N row select lines are selectable by the decoder in response to M inputted row addresses; and a set of M latches coupled to each of the N row select lines, wherein each set of latches comprises a row select latch and a first pre-write latch.

2. The row addressing circuit of claim 1, wherein each set of latches further includes a second pre-write latch.

3. The row addressing circuit of claim 1, wherein each of the M latches comprises an enable input for independently enabling each of the latches within each set of latches.

4. The row addressing circuit of claim 3, wherein a first one of the M latches in each set shares a first enable signal.

5. The row addressing circuit of claim 3, wherein a second one of the M latches in each set shares a second enable signal.

6. The row addressing circuit of claim 1, wherein an output of each of the M latches in each set is coupled together with a logical OR gate.

7. A method of addressing multiple rows of a display in a single cycle, comprising:

providing a decoder coupled to a plurality of signal lines, wherein each signal line is further coupled to a dedicated latch set having a row select latch, a first pre-write latch, and a second pre-write latch;

providing a first enable signal line that is shared by each of the row select latches, a second enable signal line that is shared by each of the first pre-write latches, and a third enable signal line that is shared by each of the second pre-write latches;

beginning a row cycle;

inputting and decoding a row select address and selecting a first signal line;

enabling the row select latch via the first enable signal line;

inputting and decoding a first pre-write address and selecting a second signal line;

enabling the first pre-write latch via the second enable signal line;

inputting and decoding a second pre-write address and selecting a third signal line;

enabling the second pre-write latch via the third enable signal line;

ending the row cycle.

8. The method of claim 7, comprising the further step of activating a first row of the display for displaying pixel data at the row select address.

9. The method of claim 8, comprising the further step of activating a second row of the display for receiving pre-write data at the first pre-write address.

10. The method of claim 9, comprising the further step of activating a third row of the display for receiving pre-write data at the second pre-write address.

11. A row addressing circuit for addressing multiple rows of a visual display in a single cycle, comprising:

a decoder coupled to a plurality of signal lines, wherein the decoder includes a system for decoding a row select address, a first pre-write address and a second pre-write address and selecting three corresponding signals lines during the single cycle; and wherein each of the plurality of signal lines is further coupled to a dedicated latch set, wherein each latch set includes a row select latch, a first pre-write latch, and a second pre-write latch.

12. The row addressing circuit of claim 11, further comprising:

a first enable signal line that is shared by each of the row select latches;

a second enable signal line that is shared by each of the first pre-write latches; and a third enable signal line that is shared by each of the second pre-write latches.

13. The row addressing circuit of claim 12, wherein each of the first, second, and third enable signal lines can be independently enabled.

14. The row addressing circuit of claim 11, wherein each latch acquires data from the decoder at a first transition of an enable signal line, and is reset at a second transition of the enable signal line.

15. The row addressing circuit of claim 11, wherein each latch set comprises outputs coupled together via a logical OR gate.

16. The row address circuit of claim 11, wherein the visual display comprises a liquid crystal display.

* * * * *